US006425145B1

(12) United States Patent
Parsons et al.

(10) Patent No.: US 6,425,145 B1
(45) Date of Patent: Jul. 30, 2002

(54) PUSH BUTTON FOR METERED FLOW

(75) Inventors: Natan E. Parsons, Brookline; Robert S. Shamitz, Brighton; Kay Herbert, Winthrop, all of MA (US)

(73) Assignee: Arichell Technologies, Inc., West Newton, MA (US)

( * ) Notice: Subject to any disclaimer, the term of this patent is extended or adjusted under 35 U.S.C. 154(b) by 47 days.

(21) Appl. No.: 09/957,761

(22) Filed: Sep. 21, 2001

(51) Int. Cl.[7] ..... E03D 1/34

(52) U.S. Cl. ..... 4/379; 251/57; 251/60; 251/61.4; 251/39

(58) Field of Search ..... 4/379; 251/57, 251/60, 61.4, 50, 48, 38, 39, 33

(56) References Cited

U.S. PATENT DOCUMENTS

| | | | | |
|---|---|---|---|---|
| 2,182,873 A | * | 12/1939 | King | 137/484.2 |
| 2,320,886 A | * | 6/1943 | Quiroz | 137/505.2 |
| 2,389,413 A | * | 11/1945 | Carlton | 137/12 |
| 2,760,204 A | * | 8/1956 | Joanis | 4/367 |
| 2,858,546 A | | 11/1958 | Tekenos et al. | |
| 3,064,675 A | * | 11/1962 | Johnson et al. | 137/489.5 |
| 3,113,756 A | * | 12/1963 | Griffo | 251/57 |
| 3,677,294 A | | 7/1972 | Gibbs et al. | |
| 3,689,025 A | * | 9/1972 | Kiser | 251/25 |
| 3,747,621 A | | 7/1973 | Tine | |
| 3,817,279 A | | 6/1974 | Larson | |
| 3,817,489 A | | 6/1974 | Carson et al. | |
| 3,820,171 A | | 6/1974 | Larson | |
| 3,820,754 A | | 6/1974 | Caron et al. | |
| 4,034,423 A | | 7/1977 | Milnes | |
| 4,077,602 A | | 3/1978 | Klessig | |
| 4,088,297 A | * | 5/1978 | Doyle et al. | 251/44 |
| 4,141,091 A | | 2/1979 | Pulvari | |
| 4,193,145 A | | 3/1980 | Gross et al. | |
| 4,233,698 A | | 11/1980 | Martin | |
| 4,304,015 A | | 12/1981 | Hubatka | |
| 4,357,720 A | | 11/1982 | Stahli | |
| 4,575,880 A | | 3/1986 | Burgess | |

(List continued on next page.)

FOREIGN PATENT DOCUMENTS

| | | |
|---|---|---|
| EP | 312750 | 4/1991 |
| EP | 0828103 | 3/1998 |
| GB | 1332995 | 10/1973 |
| GB | 2277108 | 10/1994 |
| GB | 2277750 | 11/1994 |
| GB | 2329452 | 3/1999 |
| WO | 98/06910 | 2/1998 |
| WO | 98/10209 | 3/1998 |

*Primary Examiner*—Gregory L. Huson
*Assistant Examiner*—Huyen Le
(74) *Attorney, Agent, or Firm*—Cesari and McKenna, LLP

(57) ABSTRACT

By depressing a push button (13), a user deforms a flexible diaphragm (30) and thereby causes an incompressible fluid to flow from a first actuation-chamber segment (42) through openings (48) in a divider wall (46) and into a second chamber segment (44). That flow deforms a second flexible diaphragm (40), which accordingly causes an actuator shaft (58) to break the seal formed by an O-ring (57) and thereby permit flow from a main valve inlet (11) through a main valve outlet (12). When the user releases the push button (13), an actuator check valve (50) prevents the incompressible fluid from returning through the divider-wall openings (48) to the first chamber segment (42). The actuator therefore returns only slowly, through a bleed orifice (72). A pressurizer conduit (86) communicates the valve's outlet pressure to a stop chamber (82) and thereby causes the position of a stop member (76) to be dependent on that pressure. The position of the stop member (76) determines the length of the button travel and thus the time required for the valve to close. This reduces the effect of inlet pressure on the amount of fluid that one valve operation causes to be delivered.

14 Claims, 3 Drawing Sheets

U.S. PATENT DOCUMENTS 4,662,395 A 5/1987 Strangefeld
4,756,031 A 7/1988 Barrett
4,832,310 A 5/1989 Nestich
4,941,215 A 7/1990 Liu
5,003,643 A 4/1991 Chung
5,005,226 A * 4/1991 Basile et al. ..... 4/354
5,046,201 A 9/1991 Steinhardt et al.
5,187,818 A 2/1993 Barrett, Sr. et al.
5,313,673 A 5/1994 Saadi et al.
5,335,694 A 8/1994 Whiteside
5,341,839 A 8/1994 Kobayashi et al.
5,361,426 A 11/1994 Martin
5,400,446 A 3/1995 Bloemer et al.
5,427,351 A * 6/1995 Korfgen et al. ..... 251/39
5,431,181 A 7/1995 Saadi et al.
5,435,019 A 7/1995 Badders
5,603,127 A 2/1997 Veal
5,649,686 A 7/1997 Wilson
5,652,970 A * 8/1997 Wodeslavsky ..... 4/378
5,722,454 A * 3/1998 Smith et al. ..... 137/503
5,802,628 A 9/1998 Spoeth et al.
5,857,661 A * 1/1999 Amada et al. ..... 251/57
5,884,667 A 3/1999 North
5,920,919 A 7/1999 Chang
5,970,527 A 10/1999 Martin et al.

* cited by examiner

PUSH BUTTON FOR METERED FLOW

BACKGROUND OF THE INVENTION

1. Field of the Invention

The present invention is directed to valves, and in particular to valves of the delayed-closure variety.

2. Background Information

There are many applications in which it is desired that manual-valve operation result in only a limited amount of flow. One example occurs in public restrooms, where it is desirable not to rely on users to turn faucets off. To achieve this end, faucets are opened by push buttons or similar operators that return automatically to their rest states when they are released and thereby permit their valves to close again. But it would be inconvenient for the water flow to stop as soon as the user releases the actuator, since the user typically wants to wash the hand that be used to press the push button. So the valve is arranged to impose a time delay.

U.S. patent application Ser. No. 09/761,533, which was filed on Jan. 16, 2001, by Parsons et al. for a Flush Controller Having Remote Time-Delay Valve, gives an example of another use for delayed-closure valves. In that arrangement, such a valve is employed to control pressure relief of a pilot chamber whose pressurization causes a toilet's flush valve to close and whose depressurization allows it to open. The user depresses a push button only momentarily, but the pilot chamber's pressure must remain relieved long enough to result in an effective flush. The delay imposed by the particular type of valve described in that application depends on the operator travel that caused the valve to open, and that application describes ways of controlling flush volume by making the operator travel adjustable.

In short, there are many applications in which it is desired to supply a predetermined flow volume, and significant effort has therefore been expended to provide effective valve systems for that purpose.

SUMMARY OF THE INVENTION

I have found a way of so improving such valves as to increase the accuracy with which they deliver a predetermined flow volume. Specifically, I make the delay duration decrease as the valve's inlet pressure increases. This reduces the delivered-volume variation that pressure changes can cause.

Specifically, I provide an operator stop that defines the travel limit of the operator by which the user causes the valve to open. The length of that travel largely determines the valve's closure delay, and I make the stop resiliently expandable so as to vary the travel that the stop permits. In particular, a pressurizer conduit places the valve inlet into communication with an interior chamber that the stop forms, and pressurizing that chamber tends to expand the stop and thereby reduce the operator's range of travel. This makes the delay relatively low when the pressure is relatively high. It thereby compensates for the higher rate of flow that the higher pressure tends to cause.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
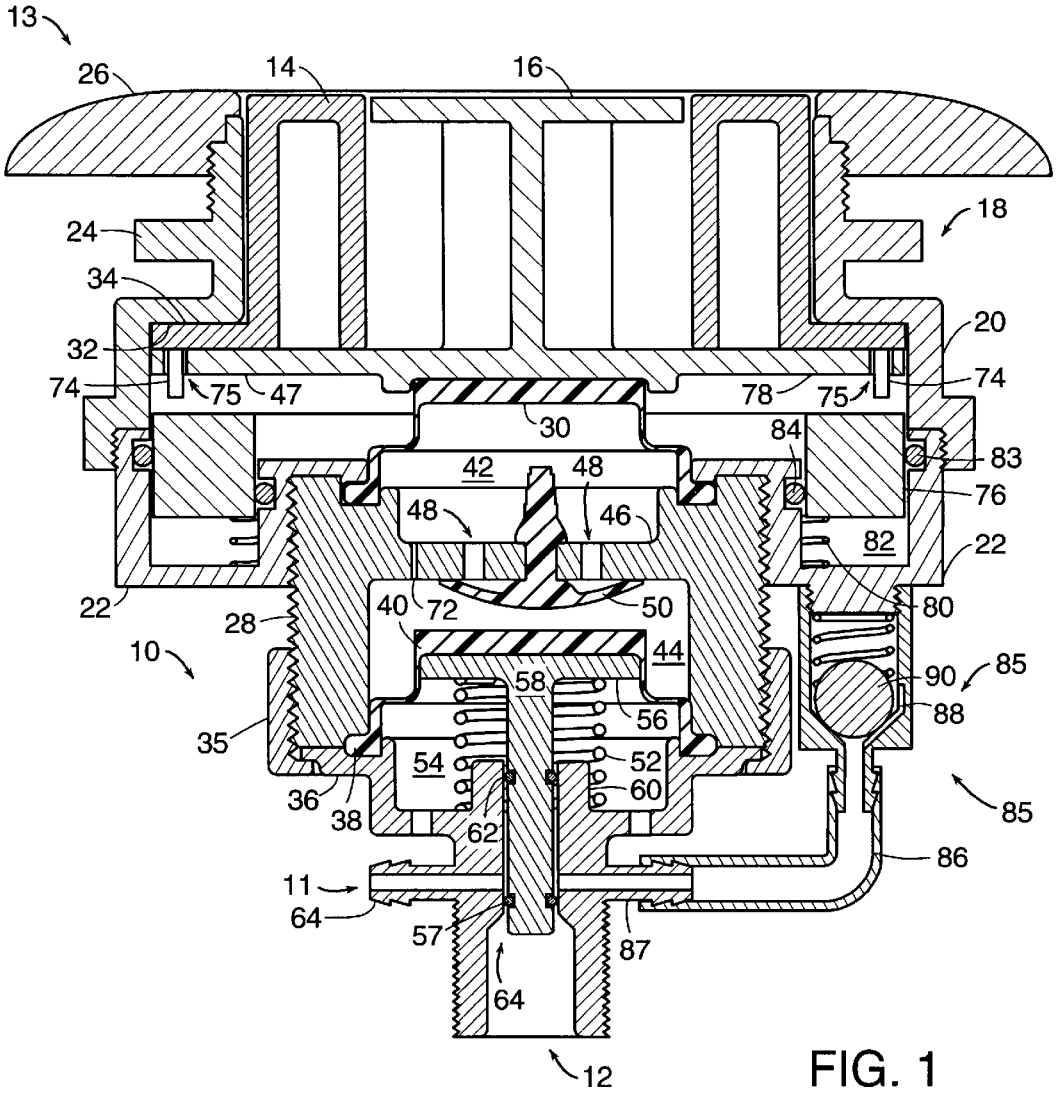
FIG. 1 is a cross-section of a valve that employs the present invention's teachings.

FIG. 1 is a cross section of a valve 10 that employs the present invention's teachings to control flow from its inlet 11 to its outlet 12. The operator that the user depresses to open the valve 10 is a push button 13. Suppose for the sake of example that the valve is being used to control a flush-valve operator. The user typically will not keep the button depressed long enough for the required flush volume to flow. But the valve 10 nonetheless remains open long enough, as will now be explained.

In the illustrated embodiment, the push button 13 actually is a compound button consisting of outer and inner button members 14 and 16. Those button members are disposed within an operator housing 18 that includes an outer housing member 20 and an inner housing member 22 threadedly secured to it. The outer housing member 20 forms a flange 24 that cooperates with an end cap 26 to secure the valve assembly to some support such as a toilet-tank wall. An actuator frame 28 is threadedly secured to the inner operator-housing member 22 and cooperates with it to clamp a flexible diaphragm 30 into position. Flexible diaphragm 30 urges the inner button member 16 upward in FIG. 1, but a knee 32 that the outer operator-housing member 20 forms so engages a shoulder 34 formed by the outer button member 14 as to retain the inner button member 16 within the housing.

A nut 35 that threadedly engages the actuator housing 28 secures a valve housing 36 to the actuator housing 28 and thereby clamps into a fixed position an annular lip 38 formed at the end of a second flexible diaphragm 40. Together with the actuator housing 28, the first and second flexible diaphragms 30 and 40 form an actuator chamber divided into first and second chamber segments 42 and 44 separated by a divider wall 46 that the actuator housing 28 forms.

The inner and outer button members 16 and 14 are so sized that a user depressing button 13 will ordinarily depress the outer button member unless he takes care to concentrate on the inner member only. When the outer button member 14 is depressed, it in turn presses down on the inner member's plate portion 47, and this causes the first flexible diaphragm 30 to deform in such a manner as to reduce the volume of the first chamber segment 42. But the actuation chamber that segments 42 and 44 form is filled with an incompressible fluid such as distilled water, and a reduction in the first chamber segment 42's volume causes the second segment 44's volume to increase. Specifically, the incompressible fluid flows from the first chamber segment 42, through openings 48, past the lips of a flexible check-valve member 50, and into the second chamber segment 44. As a result, the second flexible diaphragm 40 deforms downward: the second chamber segment grows in volume.

This deformation of the second flexible diaphragm 40 occurs against the force of a compression spring 52, which is disposed within a spring chamber 54 that the second flexible diaphragm 40 cooperates with the valve housing 36 to form. That spring bears against an actuator head 56 that in turn bears against the second flexible diaphragm 40 to bias it into the illustrated position. In that position, an O-ring 57 mounted on the actuator's shaft 58, which is disposed within a guide 60 that the valve housing 36 forms, keeps water in the inlet 11 from flowing to the outlet 12. A second O-ring 62 prevents inlet water from flowing into the spring chamber 54. The just-explained downward deformation of the second flexible diaphragm 40 in response to a user's pressing the push button moves the lower O-ring 57 into an expanded region 64 and thus breaks its seal. This permits flow from the valve inlet 11 to the valve outlet 12.

When the user releases the push button, spring 52 causes the second flexible diaphragm 40 to return to the illustrated rest state. For that return to occur, the incompressible fluid has to flow back from the second chamber segment 44 to the first chamber segment 42. Check-valve member 50 prevents that return flow from occurring through the low-flow-resistance path that the relatively large divider-wall openings 48 provide. Instead, the returning fluid must all flow through a small divider-wall bleed orifice 72, so the return flow is slow, requiring at least two seconds before the actuator shaft 58 can reach a position in which the lower O-ring re-seals against the guide 60's wall and again prevents main valve flow.

Of course, the actual closure delay depends on the orifice size, the incompressible fluid's viscosity, and the actuation-chamber size. But it additionally depends upon the degree of deformation from which the flexible diaphragms need to recover, and this in turn depends on the length of button travel. When the user pushes the outer button, outer button legs 74 move downward through plate-portion holes 75 until they meet a stop surface provided by an annular stop member 76. The distance from legs 74's rest position to the position of the stop member 76 thus determines the button travel when the user pushes the outer button member. If the user instead pushes only on the inner button member, though, that button member can travel a little farther, since it does not stop until the inner button member's plate portion 47 encounters stop member 76. This feature of enabling the user to choose between closure delays is of particular utility when the valve to controls toilet flushing; pressing the outer button results in a normal flush, while pressing only on the inner button results in a fuller flush. In both cases, it is the stop member 76's position that determines the button travel and thus the closure delay.

Stop member 76's position depends in turn on the valve's inlet pressure, as will now be explained. The inner operator-housing member 22 and the stop member 76 co-operate with a tension spring 80, which is secured to them, to form a resiliently expandable stop. The stop defines an internal stop chamber 82, which O-rings 83 and 84 seal. A check valve 85 allows fluid to flow from a pressurizer conduit 86 into chamber 82 from a pressurizer port 87. That port communicates with the inlet 11 by way of the clearance between the actuator shaft 58 and the actuator guide 60's wall. Pressure at the valve inlet 11 thus can pressurize the stop chamber 82. The tension spring 80 tends to urge the stop member 76 toward the inner operator-housing member's lower end and thereby reduce the stop chamber's size. But the force that the inlet pressure exerts on the stop member 76 acts against the spring force and thus tends to expand the expandable stop.

The degree of stop expansion depends on the inlet pressure: the greater that pressure is, the more the actuator stop expands. Greater stop expansion results in the button travel's being more limited and thereby in less delay before the main valve closes. This shorter closure delay tends to compensate for the greater main-valve flow rate that a higher pressure causes. That is, it reduces pressure-caused variations in the volume of liquid that a single push-button operation allows to pass through the main valve.

Now, the outlet pressure typically undergoes a sudden reduction when the user operates the valve and thus permits flow from the valve inlet 11 through the valve outlet 12. But the pressurizer check valve 85, which readily permits fluid flow from the valve outlet 11 through the pressurizer conduit 85 to the stop chamber 76 to pressurize it, retards flow through conduit 86 in the other direction. It thereby tends to keep the stop expanded to the size that the inlet pressure dictated before the valve was opened. So the stop remains expanded throughout the duration of a closure delay, i.e., throughout the time when the valve is open. The stop-chamber pressure will nonetheless adjust to inlet-chamber pressure reductions that occur while the valve is closed, because a bleed slot 88 formed in the valve member 90's seat permits depressurization over a longer time scale. Other embodiments may instead provide a bleed passage 91 through the valve member rather than around it.

Figure 4:
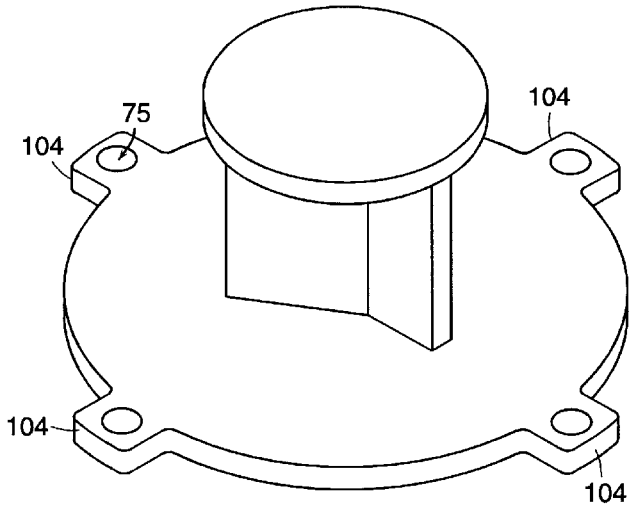
FIG. 4 is an isometric view of the inner button member employed in the FIG. 2 embodiment.

Although, for the sake of simplicity, FIG. 1 depicts the stop member 76 as providing a single-level stop surface, it may be advantageous to have it provide several levels of stop surface so that a choice of closure-delay range can be made while the valve is being assembled or installed. A stop member such as FIG. 2's stop member 76' may be employed for this purpose. That stop member is provided with a generally cylindrical extension 94, from which partitions 96 extend radially inward to form key ways 98. FIG. 3, which is a top view of the valve assembly with its end plate 26 and outer operator-housing member 20 removed, show that the outer button in such an embodiment forms keys 102 that fit into four key ways spaced by equal angles from each other. As FIG. 4 shows, the inner button similarly forms keys 104 that fit into those key ways.

Figure 2:
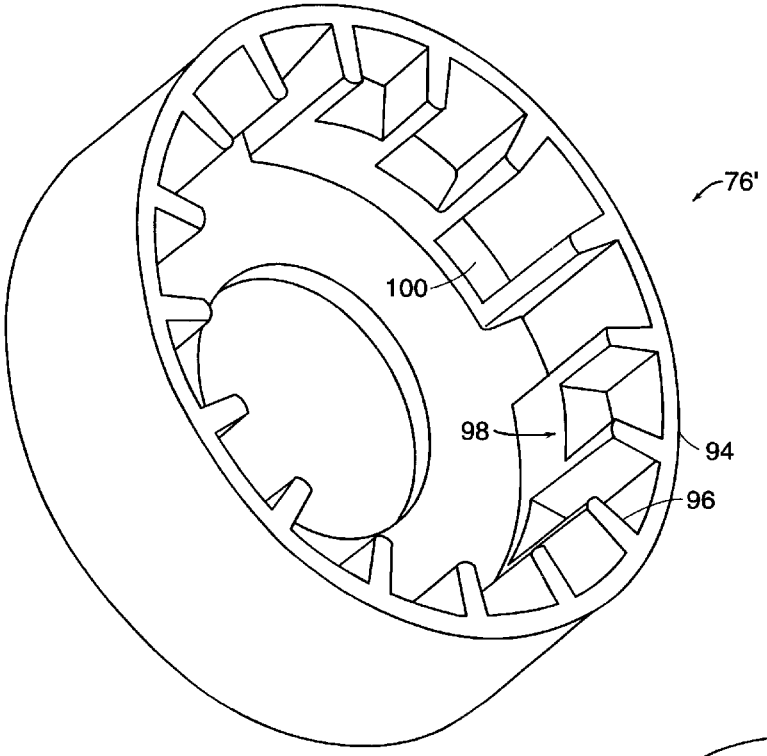
FIG. 2 is an isometric view of a stop member employed in an alternative embodiment of the present invention.
Figure 3:
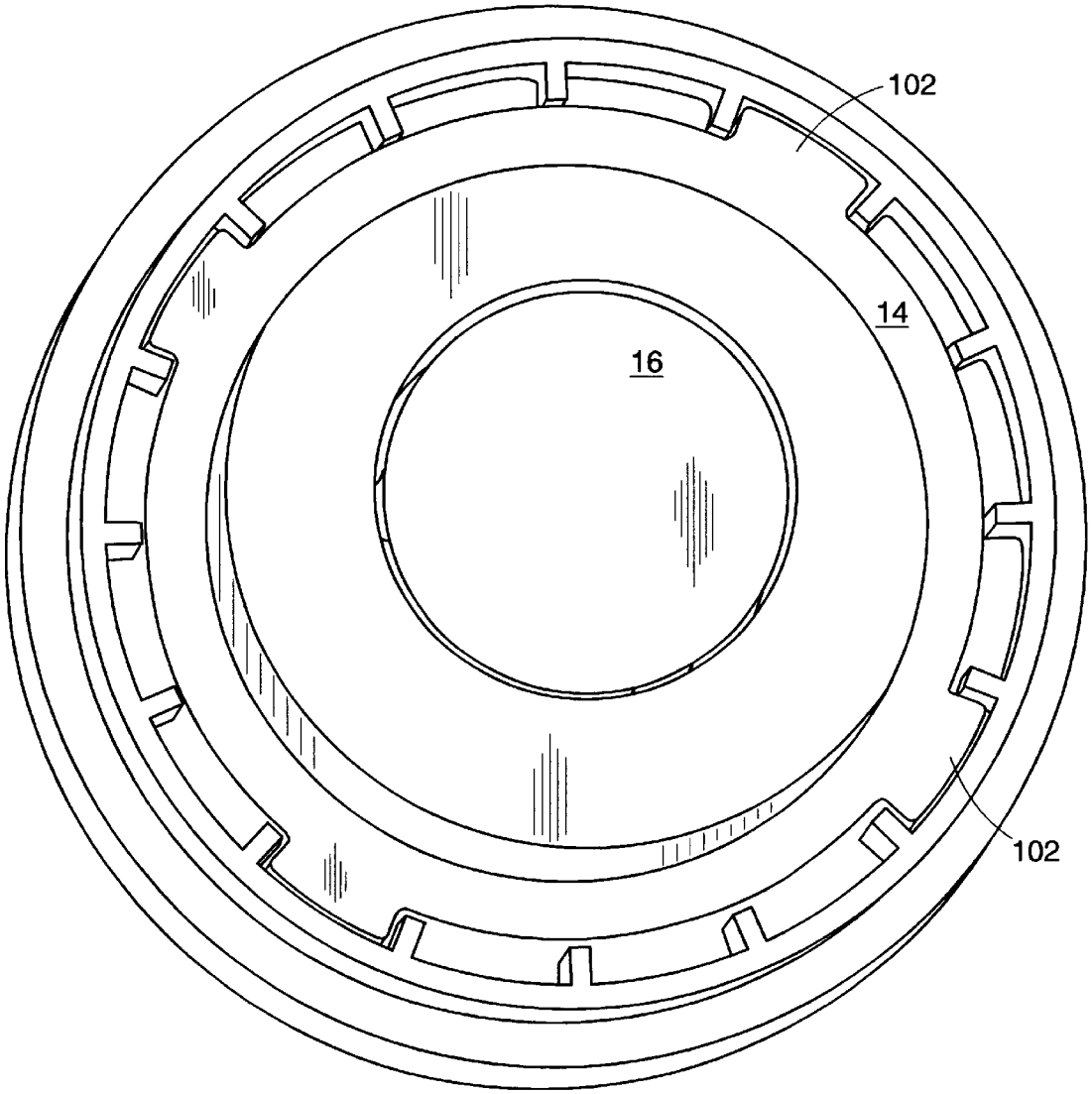
FIG. 3 is a plan view of the FIG. 2 embodiment with parts removed.

FIG. 2 shows that the different key ways have different-height stop surfaces 100. The heights repeat so that each key in any set of four key ways spaced by 90° from each other, such as the set that keys 104 of FIG. 4 occupy, have the same height. When the button is assembled, the assembler chooses the closure-delay range by selecting the set of four key ways into which he inserts the outer-button and inner-button keys 102 and 104.

By employing the present invention's teachings, one can produce a valve system whose closure delay responds to inlet pressure in such a fashion as to reduce the variability in delivered liquid volume that inlet-pressure variations could otherwise cause. Although the environment particularly described above for the valve system is that of a toilet flusher, it is apparent that it is similarly applicable to faucets and other environments in which metered flow is desired. The invention thus constitutes a significant advance in the art.

What is claimed is:

1. A pressure-responsive valve system comprising:

A) a delayed-closure valve forming a valve outlet and a valve inlet through which fluid can be introduced into the valve at an inlet pressure, the delayed-closure valve being operable from a closed state, in which the delayed-closure valve prevents flow therethrough from the valve inlet to the valve outlet, through a range of open states, in which it permits such flow, the delayed-closure valve being so biased that, after release from a given open state, it returns to the closed state after a closure delay that varies with how far the given state is into the range of open states;

B) a valve operator biased to a retracted position, in which it permits the delayed-closure valve to remain in its closed position, and manually operable through a range of extended positions, in each of which it holds the valve in corresponding open states within the range thereof;

C) an operator stop forming a stop pressure chamber and being resiliently expandable by pressurization of the stop pressure chamber, the operator stop being positioned to reduce the range of the valve operator's extended positions as the operator stop expands; and D) a pressurizer conduit so extending from the valve inlet to the stop pressure chamber that the stop pressure chamber receives the inlet pressure, whereby the closure delay decreases with increases in inlet pressure.

2. A pressure-responsive valve system as defined by claim 1 further including a check valve so interposed in the pressurizer conduit as to permit fluid flow from the valve inlet toward the stop pressure chamber but retard flow from the stop pressure chamber toward the valve inlet.

3. A pressure-responsive valve system as defined by claim 2 wherein the valve system forms a bleed orifice that permits flow from the stop pressure chamber toward the valve inlet with a flow resistance greater than that with which the check valve permits flow from the valve inlet toward the stop pressure chamber.

4. A pressure-responsive valve system as defined by claim 3 wherein:

A) the check valve includes a check-valve member resiliently biased toward a valve seat, from which flow from the valve inlet toward the stop pressure chamber tends to unseat it; and B) the check-valve member forms the bleed passage therethrough.

5. A pressure-responsive valve system as defined by claim 1 wherein the operator stop includes a stop base and a stop member, positioned to stop the valve operator, that cooperates with the stop base to define the stop chamber and is resiliently displaceable with respect thereto to provide the resilient expansion of the operator stop.

6. A pressure-responsive valve system as defined by claim 5 wherein the operator stop further includes a stop spring that biases the stop member against displacement that expands the operator stop.

7. A pressure-responsive valve system as defined by claim 6 wherein the spring is a tension spring acting between the stop member and the stop base.

8. A pressure-responsive valve system as defined by claim 5 further including a check valve so interposed in the pressurizer conduit as to permit fluid flow from the valve inlet toward the stop pressure chamber but retard flow from the stop pressure chamber toward the valve inlet.

9. A pressure-responsive valve system as defined by claim 8 wherein the valve system forms a bleed orifice that permits flow from the stop pressure chamber toward the valve inlet with a flow resistance greater than that with which the check valve permits flow from the valve inlet toward the stop pressure chamber.

10. A pressure-responsive valve system as defined by claim 1 wherein the delayed-closure valve includes:

A) a valve seat surrounding the valve inlet;

B) a valve operator;

C) chamber walls, including first and second displaceable walls, forming a closed actuator chamber, the first displaceable wall being coupled to the valve operator for displacement thereby;

D) an incompressible fluid that fills the actuator chamber, whereby displacement of the first displaceable wall by the valve operator results in displacement of the second displaceable wall;

E) a valve member coupled to the second displaceable wall for displacement therewith between a closed state, to which it is biased and in which it so seats in the valve seat as to prevent flow from the valve inlet to the valve outlet, and an open state, in which it permits such flow; and F) an actuation-chamber divider that divides the actuator chamber into first and second chamber segments in which the first and second displaceable walls are respectively located, the divider providing such higher flow resistance to flow of the incompressible fluid therethrough from the second chamber segment to the first chamber segment than from the first chamber segment to the second chamber segment as, when the valve operator has been held in a position in which the operator stop stops it, to impose a time delay of at least two seconds between release of the valve operator and closure of the valve.

11. A pressure-responsive valve system as defined by claim 10 wherein the actuation-chamber divider includes a check valve positioned and oriented to permit flow from the first chamber segment to the second chamber segment but retard flow from the second chamber segment to the first chamber segment.

12. A pressure-responsive valve system as defined by claim 11 wherein:

A) the actuation-chamber divider includes a divider wall forming forward and reverse passages therethrough; and B) the check valve is positioned and oriented to:

i) permit flow from the first chamber segment to the second chamber segment through the forward and reverse passages both; and ii) permit flow from the second chamber segment to the first chamber segment through the reverse passage but not through the forward passage.

13. A pressure-responsive valve system as defined by claim 10 further including a check valve so interposed in the pressurizer conduit as to permit fluid flow from the valve inlet toward the stop pressure chamber but retard flow from the stop pressure chamber toward the valve inlet.

14. A pressure-responsive valve system as defined by claim 13 wherein the valve system forms a bleed orifice that permits flow from the stop pressure chamber toward the valve inlet with a flow resistance greater than that with which the check valve permits flow from the valve inlet toward the stop pressure chamber.

* * * * *